United States Patent [19]

Csaszar

[11] Patent Number: 4,461,390

[45] Date of Patent: Jul. 24, 1984

[54] TAMPER-EVIDENT PLASTIC CLOSURE

[75] Inventor: Ernest J. Csaszar, Mountainside, N.J.

[73] Assignee: General Kap (P.R.) Corporation, Puerto Rico, P.R.

[21] Appl. No.: 383,705

[22] Filed: Jun. 1, 1982

Related U.S. Application Data

[63] Continuation-in-part of Ser. No. 142,429, Apr. 21, 1980, Pat. No. 4,343,408.

[51] Int. Cl.[3] ..... B65D 41/34

[52] U.S. Cl. ..... 215/252; 215/258

[58] Field of Search ..... 215/252, 253, 258, 329, 215/256, DIG. 1

[56] References Cited

U.S. PATENT DOCUMENTS

| | | | |
|---|---|---|---|
| 3,438,528 | 8/1967 | Fields . | |
| 3,455,478 | 7/1969 | Fields . | |
| 3,463,341 | 8/1969 | Fields . | |
| 3,673,761 | 7/1972 | Leitz | 215/252 |
| 3,750,821 | 8/1973 | Sourbet . | |
| 3,904,062 | 9/1975 | Grussen . | |
| 3,944,102 | 3/1976 | Grau . | |
| 3,955,696 | 5/1976 | Finke . | |
| 4,126,240 | 11/1978 | Brach . | |
| 4,147,268 | 4/1979 | Patel . | |
| 4,165,813 | 8/1979 | Babiol . | |
| 4,241,841 | 12/1980 | Boller . | |
| 4,278,180 | 7/1981 | Willis . | |
| 4,305,516 | 12/1981 | Perne et al. . | |
| 4,322,011 | 3/1982 | Mumford . | |
| 4,322,012 | 3/1982 | Conti . | |
| 4,343,408 | 8/1982 | Csaszar | 215/258 |
| 4,352,436 | 10/1982 | Chartier et al. . | |

FOREIGN PATENT DOCUMENTS

| | | |
|---|---|---|
| 79597 | 5/1955 | Brazil . |
| 175598 | 10/1965 | Brazil . |
| 25910 | 9/1971 | Chile . |
| 26774 | 6/1972 | Chile . |
| 1277 | 1/1977 | Chile . |
| 004500 | 10/1979 | European Pat. Off. . |
| 0055191 | 6/1982 | European Pat. Off. . |
| 80846 | 6/1983 | European Pat. Off.Off. . |
| 1154369 | 9/1963 | Fed. Rep. of Germany . |
| 1955047 | 5/1971 | Fed. Rep. of Germany . |
| 1347895 | 11/1962 | France . |
| 1536459 | 7/1967 | France . |
| 1581775 | 9/1969 | France . |
| 2320870 | 3/1977 | France . |
| 196899 | 10/1973 | Spain . |
| 1309057 | 3/1973 | United Kingdom . |
| 1593072 | 7/1981 | United Kingdom . |

*Primary Examiner*—George T. Hall

*Attorney, Agent, or Firm*—Lerner, David, Littenberg, Krumholz & Mentlik

[57] ABSTRACT

Tamper-evident closures which are useful in conjunction with various bottles and containers are disclosed. The closures are intended to be used in connection with containers having threaded necks above an annular collar, and they comprise one-piece closures including a horizontal end wall, a cylindrical side wall including an internally threaded upper portion, a depending lower skirt portion which includes an inwardly projecting bead adapted to engage the annular collar on the container, and an intermediate side wall portion therebetween. The intermediate side wall portion of the closure includes an area of weakness which is designated to fracture when the closure is unthreaded from the container, thereby leaving the lower skirt portion engaged to the annular collar on the container after the end wall and internally threaded upper portion of the closure have been removed. The area of weakness includes a bridge portion which is sufficiently thin and flexible that it can collapse when the closure is being applied, whereby the faces of the intermediate side wall on either side of the bridge portion come into abutment with each other, and the bridge portions therefore do not prematurely fracture. The closure also includes stabilizers to prevent these abutting wall portions from moving relative to each other while the brige portions have collapsed.

34 Claims, 11 Drawing Figures

TAMPER-EVIDENT PLASTIC CLOSURE

CROSS-REFERENCE TO RELATED APPLICATIONS

This application is a continuation-in-part of U.S. patent application Ser. No. 142,429, which was filed on Apr. 21, 1980, now Pat. No. 4,343,408.

FIELD OF THE INVENTION

The present invention is directed to tamperevident closures. More specifically, the present invention is directed to such closures which include a frangible portion which fractures when the closure is removed from the container, thereby evidencing the fact that the container has been opened. Still more particularly, the present invention is directed to such closures which are useful in connection with various containers, including soda bottles and other such containers which are maintained under significant pressures.

BACKGROUND OF THE INVENTION

Both plastic and metal closures for various bottles and containers which include a tamper-evident feature have been known for many years. In most cases, this tamper-evident feature comprises a lower shoulder or skirt portion of the closure which is in some way intended to fracture or break upon removal of the closure from the container, so that it then becomes evident that the container has been opened. While a large number of these closures have been known in the past, on a commercial basis, and particularly in connection with soda bottles and other such containers maintained under significant pressures, up until quite recently metal closures have predominated. These include closures such as those shown in U.S. Pat. No. 3,812,991 which issued on May 28, 1974 to the Coca Cola Company, and many others.

The many problems encountered in connection with the use of metal closures however, have been significant. They primarily relate to the fact that in an unacceptably large proportion of cases, removal of the closure does not result in a clean and efficient fracture of the lower skirt portion, therefore making removal of the closure quite difficult and/or eliminating the tamper-evident feature completely. In addition, the cost of metal closures has recently increased dramatically, and the search for efficient plastic closures has therefore intensified.

In connection with plastic closures of this type, again a large number have been known in the past, but no commercial closure has been found which can be applied in a single step to the container or bottle, (i.e., they generally require a two-step application procedure), and can at the time result in efficient breaking or fracturing upon its removal. One recent commercial closure which is now widely utilized is that of U.S. Pat. No. 4,033,472 to Albert Obrist AG, which issued on July 5, 1977. This closure, however, again suffers from both of these infirmities. In the first place it requires a two-step application procedure, i.e., initial application of the closure to the bottle followed by a heating process whereby the lower depending bead 4 is deformed against the surface of the bead or collar on the bottle itself, as shown in FIG. 4 thereof. In addition, it has again been found that these closures, although used commercially, do not fracture properly in an unacceptable proportion of cases. Several other issued patents which include such two-step application procedures include U.S. 3,673,761 assigned to Ciba-Geigy AG, and U.S. Pat. No. 3,788,509 to Keeler, which includes a separate heating step for producing the weakened zones themselves.

Among those patents which do show a one-piece plastic closure, which does not require such a heat sealing step are those to Hamberger, namely U.S. Pat. Nos. 2,162,711 and 2,162,712. These patents, however, are directed to closures which include a weakened portion defined by corresponding grooves on the shoulder portion (see FIG. 1 thereof) of the depending skirt 23. In these closures fracture thus occurs in a vertical direction with respect to the closures and tangentially with respect to the lugs 18 to which the skirt is attached. In addition, the skirt portion in this patent appears to be constructed so as to be thinner than the upper walls thereof. Additional such closures are also known in the Schauer patents, namely U.S. Pat. Nos. 2,162,752 and 2,162,754. Also, U.S. Pat. No. 3,329,295, to Fields, teaches yet another such closure, which is this case includes a cylindrical skirt 17 depending from the free end of side walls 5 by means of circumferentially spaced, fracturable bridges 19. This patent further includes an inwardly directed lip 20 overlapping the annular bead 22 on the container or bottle to which it is to be applied, and requires the maintenance of a gap 26 between shoulder 24 and lip 20. Only a small portion of the cross-sectional thickness of Fields' skirt 17 is located below the outer end of side wall 5 and the wall are therefore not in substantial alignment with each other on either side of the bridges 19 thereof. None of these prior art patents teaches the structure of a truly satisfactory commercially acceptable product.

There are yet another group of patents directed to such closures which rely upon interlocking teeth or serrations in order to effect the fracture of the closure. For example, French Patent No. 1,347,895 includes a ratchet or lug means on the breakaway skirt portion 2 thereof as well as on the bottle bead, and German Pat. No. 2,349,265 also includes lugs 16 which extend inwardly from depending skirt 13 to aid in fracturing at the point of weakness thereon. Reference in this regard is also made to U.S. Pat. Nos. 3,980,195, 3,924,769 and 4,126,240.

Finally, while U.S. Pat. No. 3,784,041 to Birch principally relates to the use of an annular resilient flange 25 extending radially inward from the skirt 13, beginning at column 3, line 60 thereof, and as shown in FIGS. 5–7, a tamper evident closure cap is shown in connection with this sealing arrangement. However, the bridge portions 40 of Birch et al have a radial thickness which varies circumferentially of the closure cap 35, thus increasing in thickness in the direction of arrow 39, in which the closure cap is unscrewed from the neck of the container. Furthermore, the lowermost portion 37 of Birch et al's skirt 36 projects inwardly to a point considerably further than the plane corresponding to the inner surface of the side wall where the bottom of the threads 15 are located. Again, a closure which can truly meet all the commercial requirements for such tamper-evident closures is not shown or suggested therein.

SUMMARY OF THE INVENTION

In accordance with the present invention, a onepiece tamper-evident closure has now been discovered which cannot only be applied to containers, such as bottles, etc., in a one-step operation, but which also results in highly efficient fracturing of the depending lower skirt portion upon removal of these closures from the container. In particular, these tamper-evident closures comprise onepiece closure bodies including a horizontal end wall and a cylindrical side wall, the cylindrical side wall including an internally threaded upper portion, a depending lower skirt portion, and an intermediate side wall portion therebetween. The depending lower skirt portion includes an inwardly projecting bead which is adapted to engage the annular collar portion of a container when the closure is threaded onto the container, and the intermediate side wall portion of the closure includes a frangible portion comprising an area of weakness designed to fracture when the closure is unthreaded from the container so as to leave the depending lower skirt portion on the container after the internally threaded upper portion has been removed therefrom. The frangible portion thereby divides the intermediate side wall portion into an upper intermediate side wall portion and a lower intermediate side wall portion above and below the frangible portion, respectively, and a frangible portion comprises bridge means located circumferentially around the closure, the bridge means being sufficiently thin and flexible so as to be capable of collapsing when the inwardly projecting bead passes over the annular collar portion of the container as the closure is being threaded onto the container to thereby permit the upper and lower intermediate side wall portions to abut against each other and thereby permit the closure to be applied to the container without fracturing the bridge means, and at least a portion of the upper and lower intermediate side wall portions include juxtaposed, parallel surfaces to maintain the upper and lower intermediate side wall portions in alignment with each other upon collapse of the bridge means. In a preferred embodiment, the closure also includes stabilizer means located circumferentially around the closure to prevent the upper and lower intermediate side wall portions from rotating relative to each other upon collapse of the bridge means.

In a preferred embodiment of the closure of the present invention, the bridge means include a plurality of bridge members located circumferentially around the closure. Preferably, four such bridge members are located equidistantly around said closure. In a preferred embodiment the stabilizer means comprises interlocking male and female stabilizer means located either on the upper or lower intermediate side wall portions. In a preferred embodiment the frangible portion comprises a circumferential groove formed on the outer surface of the closure whereby the groove is bounded by the upper and lower intermediate side wall portions, and the male stabilizer means comprises tab means projecting into that groove, while the female stabilizer means comprises slot means corresponding to those tab means, whereby the tab means enters the slot means upon collapse of the bridge means. Preferably, a plurality of pairs of male and female stabilizer members are utilized.

In another embodiment of the closure of the present invention, a plurality of pairs of male and female stabilizer members alternate circumferentially around the closure with a plurality of bridge members.

In another embodiment of the closure of the present invention, the upper intermediate side wall portion comprises a substantially horizontal surface and the lower intermediate side wall portion comprises an incline surface with respect to the horizontal. Preferably, the tab means is located on the lower intermediate side wall portion and the slot means is located on the upper intermediate side wall portion.

In a preferred embodiment of the closure of the present invention, the inwardly projecting bead includes an inclined lower surface defining a plane disposed at a first angle with respect to the horizontal for assisting in the gradual outward bending of the depending lower skirt portion as it passes over the annular collar portion of the container upon being threaded onto the container without fracturing the frangible portion, and an inclined upper portion defining a plane disposed at a second angle with respect to the horizontal for engagement with the annular collar portion of the container when the closure is completely threaded onto the container, the second angle being greater than the first angle, whereby the depending lower skirt portion cannot gradually bend outward when the closure is being unthreaded from the container without causing fracture to occur.

In another embodiment of the closure of the present invention, the inwardly projecting bead extends inwardly from the cylindrical side wall a distance of between about .015 and .030 inches. Preferably it projects inwardly a distance of about .02 inches.

In another embodiment of the closure of the present invention, the container has a predetermined diameter at a location immediately below its annular collar portion, and the inwardly projecting bead extends inwardly a predetermined distance from the cylindrical side wall so as to create a minimum interal bead diameter, which corresponds substantially to the predetermined diameter of the container. Preferably, the inwardly projecting bead extends inwardly from the cylindrical side wall of the closure a distance of between about 0.015 and 0.030 inches, and the annular collar portion of the container extends outwardly from the location on the container having the predetermined diameter a distance of between about 0.015 and 0.025 inches, and preferably about 0.018 inches.

In yet another embodiment of the closure of the present invention, the outer surface of the internally threaded upper portion of the closure includes a plurality of vertical serrations, which preferably terminate a predetermined distance above the area of weakness discussed above.

In a preferred embodiment of the closure of the present invention, the closure includes sealing means located on the inner face of the end wall so as to form a seal between the closure and the container when the closure is completely threaded onto the container. In one embodiment, the sealing means comprises a yieldable sealing disc maintained against the inner face of the end wall. In another such embodiment, however, the sealing means comprises a ridge or ridges projecting from the inner face of the end wall at a location corresponding to the position where the neck portion of the container is intended to contact the end wall when the closure is completely threaded onto the container. Preferably these ridge means thus comprise a number of concentric annular projections or ridges, and preferably three such ridges, which most preferably have a substantially V-shaped configuration.

In another embodiment of the sealing means of the present invention, the end wall of the closure includes an annular sealing membrane corresponding with the intended location of the neck portion of the container and having a thickness substantially less than that of the remainder of the end wall so that the sealing membrane is substantially more flexible than the remainder of the end wall, and can conform to the shape of the neck portion of the container when the closure is completely threaded onto the container. Preferably, hinge means are located on the inner and outer annular surfaces of the sealing membrane in order to increase the flexibility of the membrane, and these hinge means will preferably be annular V-shaped grooves located on the inner face of the end wall at the inner and outer annular surfaces of the sealing membrane.

In another embodiment of the sealing means of the present invention, an annular sealing ring is provided projecting from the inner face of the end wall at a location directly adjacent to the intended location of the inner surface of the neck portion of the container upon closure, and preferably including an outwardly projecting annular bead for engagement with the inner surface of the neck portion of the container.

BRIEF DESCRIPTION OF THE DRAWINGS

The tamper-evident closure of the present invention can be further understood with reference to the drawings herein wherein.

DETAILED DESCRIPTION

Figure 5:
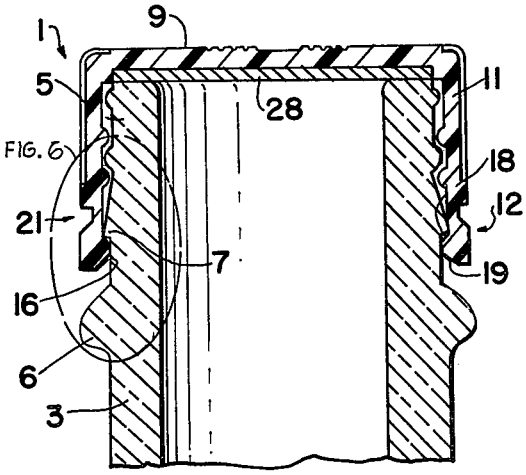
FIG. 5 is a side, elevational, cross-sectional view of a tamper-evident closure of the present invention completely threaded onto a container.

Referring to the figures, in which like numerals refer to like portions thereof, FIG. 5 shows a tamper-evident closure 1 in accordance with this invention, preferably made of a thermoplastic material, completely threaded onto a bottle or container 3. The bottle itself includes a threaded neck portion 5 and an annular collar 7 therebelow. This annular collar 7 may in some cases be referred to as a transfer bead, since in the past it has been formed in connection with the manufacture of certain types of bottles (generally glass bottles) in order to assist in the transfer or movement of the bottle during its formation, or the bottle may include a separate transfer bead 6 below the annular collar portion 7. It is, however, collar 7 to which the present tamper-evident closure will be firmly engaged or affixed, both before and after fracture of the tamper-evident portion of the closure, and furthermore which will assist in the fracturing process itself.

The closure 1 includes an upper horizontal end wall 9, and an internally threaded upper portion 11, which of course corresponds to the threaded neck portion 5 of the container to which is to be applied. The portion of closure 1 which is affixed to the collar or bead 7 when the closure is completely threaded onto the container 3 includes a depending lower skirt portion 12. The inner surface of this depending lower skirt portion 12 includes an annular bead 16, which can best be seen in FIG. 6, and which itself includes an upper surface 18 and a lower surface 19. The lower surface 19 of bead 16 has a gradual inclined or tapered surface, so that as the closure is threaded onto the container and the surface 19 comes in contact with the upper surface of bead 7 on container 3, the entire skirt portion 12 is gradually forced outward until it snaps over the bead 7, and the closure is thus completely threaded onto the container into the configuration shown in FIG. 5. On the other hand, however, when one attempts to remove closure 1 from the container 3, the upper surface 18 of bead 16, which is at an angle with the horizontal which is less than that of the lower surface 19, and which is thus firmly engaged with the corresponding lower surface of collar 7 of container 3 now prevents any such gradual outward motion of skirt portion 12, causing an efficient fracture of the closure 1 as is more fully discussed below.

Figure 1:
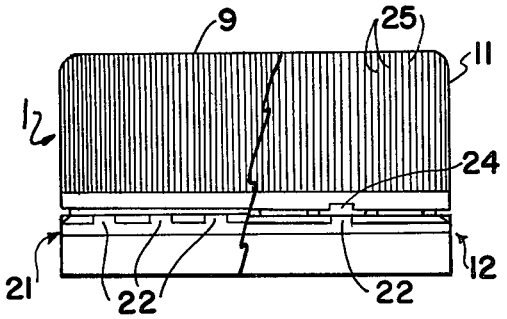
FIG. 1 is a side, elevational view of two embodiments of a tamper-evident closure of the present invention.
Figure 4:
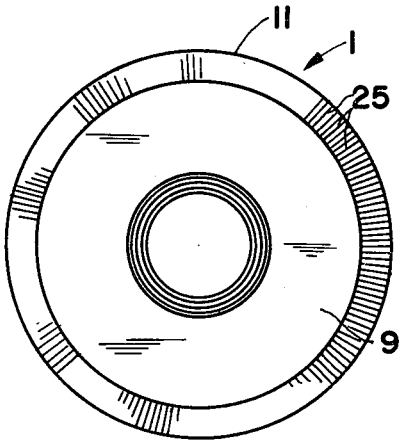
FIG. 4 is a top, elevational view of the tamper-evident closure of FIG. 1.
Figure 2:
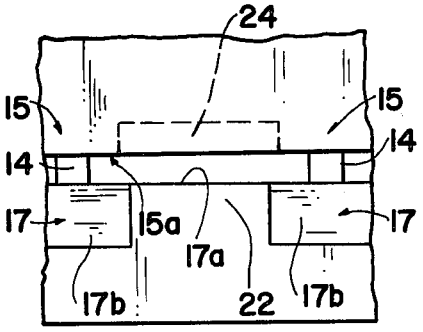
FIG. 2 is a side, elevational, enlarged view of a portion of the tamper-evident closure of FIG. 1.
Figure 3:
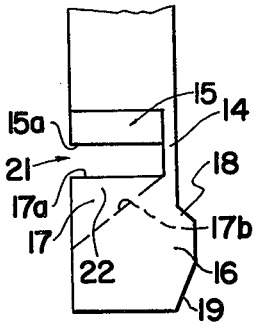
FIG. 3 is a side, cross-sectional, elevational view of the portion of the tamper-evident closure of FIG. 1 shown in FIG. 2.
Figure 6:
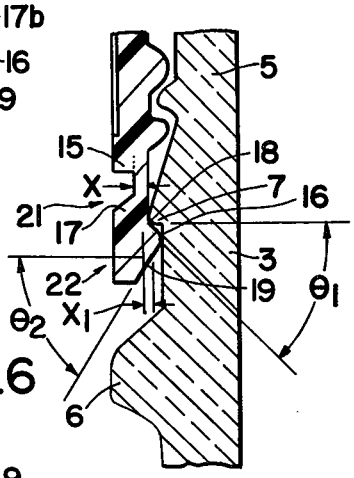
FIG. 6 is a partial, side, elevational, cross-sectional view of the circled portion of FIG. 5.

As can be seen in FIGS. 1 and 5 through 9, an area of weakness is located in the intermediate side wall portion of the closure above the annular bead portion 16 of the depending lower skirt portion 12, and below the internally threaded upper portion 11. In particular, as is shown in FIGS. 1 and 5–9, a groove 21 is located on the outer surface of closure 1. The groove 21 completely severs the intermediate side wall portion of the closure except for the remaining bridge portion(s) 14 which thus connects the upper and lower intermediate side wall portions formed by groove 21, designated as portions 15 and 17, as can be seen in FIGS. 2 and 3. The bridge means 14 preferably comprises a plurality of individual bridges located circumferentially around the closure, again as shown in FIG. 2. These bridges thus connect the upper and lower intermediate side wall portions 15 and 17, and have a thickness represented by the distance x as shown in FIG. 6, representing the distance between the bottom of groove 21 and the inner wall of the closure, and generally being a distance of from about 0.003 to 0.015 inches, preferably from about 0.006 to 0.010 inches, and most preferably about 0.008 inches, e.g., from about 0.007 to 0.009 inches. These bridges 14 are thus sufficiently thin and flexible such that as the closure is being applied to the container, and the lower surface 19 of the bead 16 comes into contact with the upper surface of the collar or bead portion 7 of the closure, bridge portion 14 can collapse, and the upper and lower intermediate side wall portions 15 and 17 thereof come into direct abutment or contact with each other. This permits the pressures which are created during application of the closure to be applied uniformly between these abutting surfaces, and not substantially entirely upon the bridge portions 14 themselves. This, in turn, prevents premature fracture of the bridges 14 upon application of the closure to the container. Thus, as the depending skirt portion 12 (i.e.—the bead 16) of the closure passes over the annular collar or bead portion 7 of the container, and flexes outwardly, this flexing motion is not transfered to the bridge portions 14, which have now collapsed, but is applied uniformly across the abutting upper and lower intermediate side wall surfaces 15 and 17. This permits the lower skirt portion 12 to pass completely over the annular collar portion 7 of the container, into the configuration shown for example in FIG. 5, without fracturing the bridge portions 14, which thereby retain their original configuration, i.e.—as shown in FIGS. 5, etc. with the upper and lower intermediate side wall portions now once again separated from each other and connected by the bridge portions 14. Furthermore, as can best be seen in FIG. 3, since at least a portion 15*a* of the upper intermediate side wall portion 15 and a portion 17*a* of the lower intermediate side wall portion 17 are juxtaposed, parallel surfaces in the horizontal plane, these surfaces are maintained in alignment with each other when the bridge portions 14 have collapsed. This result will be achieved even in the case where the entire upper intermediate side wall portion 15 is a flat surface, as shown on the left hand side of FIG. 1 and in FIG. 2, and does not include slots 24, which are discussed in more detail below. Furthermore, the entire lower intermediate side wall portion 17 can constitute a flat surface, i.e., one having the configuration of tabs 22 (also discussed in more detail below) all the way around the circumference thereof, in which case there will be no inclined portions 17*b* between separate tabs 22. Preferably, however, even where the entire upper intermediate side wall portion 15 is a flat surface, there will be four tabs 22 on the lower intermediate side wall portion, located at 90° intervals equidistantly around the circumference of the closure, so as to uniformly support the upper intermediate side wall surface upon collapse of the bridge members 14, as well as in order to facilitate the manufacturing process for the closure.

As is further shown in FIGS. 2 and 3, the closure can also include stabilizer means (22, 24), which prevent relative twisting motion as between the upper and lower intermediate side wall portions 15 and 17 when these portions are in abutment. In particular, a series of tabs 22 project from the lower intermediate side wall portion 17 into groove 21, can best be seen in FIG. 2. Correspondingly, a series of slots 24, as best shown in phantom view in FIG. 2, as well as on the right hand side of FIG. 1, can be provided in the upper intermediate side wall portion 15, so that upon collapse of bridge portions 14, tabs 22 enter slots 24, and thereby mesh with each other so as to prevent relative twisting motion between the upper and lower intermediate side wall portions 15 and 17, respectively. This can be extremely significant both in connection with application of the closures hereof to a bottle or container, and with the manufacturing process for these closures themselves. In connection with their application, when the bridge portions 14 collapse as discussed above, and the closure is being threaded onto the container, relative twisting of the upper and lower intermediate side wall portions can cause the bridges to fracture. In connection with the manufacturing process, it is also possible that in certain molding operations it would be necessary to unscrew the closures from the mold, and if the bridge portions 14 were to also collapse at this stage, such relative rotation could again result in premature fracture of the bridge portions 14. Finally, it is again preferred that these pairs of tabs 22 and corresponding slots 24 comprise four such pairs located at 90° intervals so as to be equidistantly spaced about the circumference of the closure.

Referring again to FIGS. 1 and 7 through 10, groove 21 is formed in the outer wall of closure 1 in a manner such that when fracture occurs it will occur in a generally horizontal plane across the closure 1. Furthermore, such fracture will thus occur at a location above lower depending skirt portion 12 such that the entire lower depending skirt portion 12 will then remain (after fracture) affixed to or engaged with container 3, even after internally threaded upper portion 11 is completely removed from the container. As can thus be seen, no part of the depending lower skirt portion 12 includes any weakened area therein.

Referring again to FIG. 6, and in particular to the depending lower skirt portion 12, the inwardly projecting bead 16 includes an upper surface 18 which is inclined at an angle $\theta_1$ with respect to the horizontal. This angle, $\theta_1$ is generally between about 30° and less than about 60°, and preferably about 45°, thus providing a surface which is abrupt with respect to the horizontal, i.e., across the closure. On the other hand, the lower surface 19 of the inwardly projecting bead 16 is generally inclined at an angle $\theta_2$ with respect to the horizontal. This angle, $\theta_2$, is generally greater than about 60° and up to about 80°, and preferably about 75°, thus providing a far more gradually inclined surface with respect to the horizontal. In this manner, after the closure 1 has been applied to the container 3, the upper surface 18 of the inwardly projecting bead 16 can firmly engage the bottle or container, again in the manner shown in FIG. 6. This, in turn, insures that upon unscrewing of the closure from the container 3, the bridges 14 will fracture, leaving behind the lower depending skirt 12. On the other hand, the far more gradual slope of the lower surface 19 of the inwardly projecting bead 16 permits that bead to easily move over the surface of the bead 7 on the container 3 during application of the closure, and thereby protecting bridges 14 from premature fracture during such application.

In addition, the extent to which the inwardly projecting bead 16 projects inwardly from the inner surface of the outer cylindrical wall of the closure, i.e., the distance $x_1$ as seen in FIG. 6, is also important when utilized in connection with this closure. Thus, this distance x should be between about 0.015 and 0.030 inches, and preferably about 0.02 inches. In this manner, the bead 16 will be resilient enough to stretch over the collar 7 of the container or bottle during application, while being strong enough to engage the bottom of the collar 7 when the closure is being removed from the bottle so as to permit fracture of the bridges 14. This consideration must also be taken account of in combination with the above discussion including the nature of surfaces 18 and 19 of inwardly projecting bead 16.

It has thus been found that in these ways the improved results of the present invention can be obtained, and a one-piece closure which results in a clean and efficient fracture of the weakened area upon attempting to remove the closure, results therefrom. This result is unlike any of the results which can be obtained in accordance with any such devices in the prior art.

Referring again to FIG. 1, the outer surface of closure 1 can be seen, and it includes groove 21 located between internally threaded upper portion 11 and the lower depending skirt portion 12 thereof. As can also be seen in FIG. 1, the outer surface of internally threaded upper portion 11 also includes an area which contains a plurality of vertical serrations 25 forming a linear-roughened surface thereon. This surface has been found to be not only aesthetically appealing, but it also aids in assisting one to grip the closure and twisting it in order to effect fracture and remove the internally threaded upper portion 11 therefrom.

As noted above, the closure 1 of the present invention is preferably made of a thermoplastic material, and can be manufactured in an injection molding process. Thus, the internal threads of the closure 1 can be formed by the action of an unscrewing mold. That is, after the part has been formed, during opening of the mold, the cores of the mold rotate and unscrew from the closure, thus forming the threads. The closure itself is kept from turning during this unscrewing phase by means of steel teeth, which engage the bottom of the closure and hold it in place as the core rotates.

After the unscrewing cycle is completed, a stripper plate, which is part of the mold itself, ejects the finished closure form the mold. As the mold initally opens, and before the unscrewing cycle occurs, the closure is released from an undercut position in the mold by means of angle pins which cause cam bars to separate from around the closure. This undercut position was created because protruding portions of the mold (cams) were required in order to mold the annular groove, i.e., the weak portion of the closure which is intended to fracture.

The relationship of the internal diameter of this protruding groove in the cams to the outside diameter of the mold core determines the dimension "X" shown in FIG. 6 at the deepest part of the groove, i.e., the thickness of bridge portions 14. It is also thus possible to change that dimension in the closure by merely replacing these cam sections.

The remainder of the molding process is the same as in conventional thermoplastic molding processes.

The closure of the present invention can also be adapted to be used with a variety of containers and bottles, i.e. where for example the annular collar or bead on the bottle has different dimensions from that shown in FIG. 6, or is located at different positions relative to the end of the neck 5 of the bottle, as is shown in the embodiments of FIGS. 1 through 9. Reference is specifically made to the embodiment of FIG. 9, which relates to other container which, not only includes bead 7, but which also includes an elongated raised surface 23, which is sometimes found in connection with certain containers, including certain wine bottles, etc. This elongated raised surface 23, which can have a width up to about one-half inch or so, is located between threaded neck portion 5 and bead 7.

Figure 10:
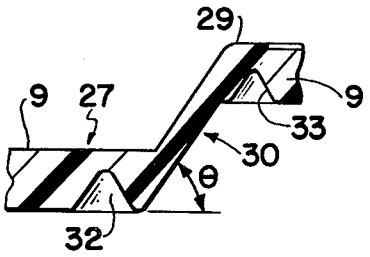
FIG. 10 is an exploded, cross-sectional view of the circled section of the tamper-evident closure of FIG. 9.

Referring to FIGS. 5, 8, 9 and 10, a number of embodiments of the closure 1 which include various sealing means are shown. Thus, in FIG. 5, a yieldable sealing disc 28, made of a material such as cork or other commercial lining materials, which will yield to a degree to absorb the pressure of the upper end of neck portion 5 when the closure 1 is completely threaded onto the container, is maintained against the inner face of end wall 9, such as by means of glue, etc. In FIG. 10, on the other hand, end wall 9 includes a circular central recessed portion 27 and an annular outer elevated portion 29. These portions are connected by means of an annular sealing membrane 30 which connects the recessed portion 27 and the elevated portion 29, and is interposed therebetween at an angle $\theta$ (see FIG. 10) of between about 25 and 45 degrees. Sealing membrane 30 comprises the same plastic material from which the entire closure is manufactured, except that whereas the remainder of the end wall 9, i.e., both the recessed portion 27 and the elevated portion 29 generally have a thickness of between about 0.040 inches and 0.060 inches, membrane portion 30 is much thinner, and will generally have a thickness of between about 0.015 inches and 0.025 inches and preferably between about 0.010 inches and 0.015 inches, such as less than about 0.025 inches. In this manner, sealing membrane portion 30 has increased flexibility so that upon threading of closure 1 onto the container, 3, the upper end wall of the neck portion of the container is pressed into contact with membrane portion 30 of end wall 9, and the membrane becomes deformed thereagainst. This produces a seal between the interior of the container and the inner wall of the internally threaded upper portion 11 of the closure 1. In addition, hinges comprising V-shaped, annular grooves 32 and 33 on the inner and outer surfaces of annular membrane portion 30 are also provided in order to further increase the flexibility of the membrane portion 30.

Figure 7:
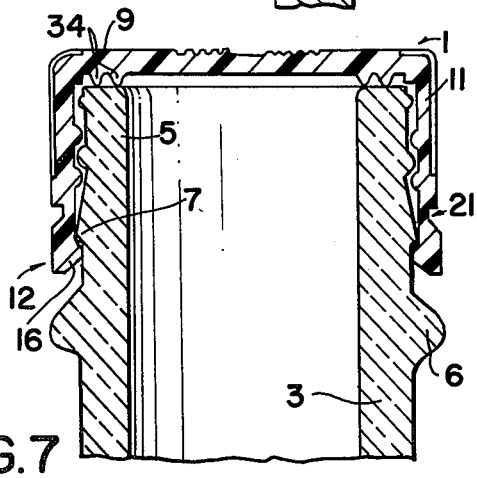
FIG. 7 is a side, elevational, cross-sectional view of another tamper-evident closure of the present invention completely threaded onto a container.

Referring next to FIG. 7 in this case the inner surface of end wall 9 includes one or more closely spaced annular ridges 34, preferably two or three such ridges, which project downwardly therefrom. These ridges, 34, which are preferably V-shaped in configuration, are located at the precise location where the upper end of the neck portion 5 of container 3 is intended to come into contact with the inner face of end wall 9 when the closure is completely threaded onto the container. In this manner, a seal is once again formed between the inner surface of the container and the inner surface of the internally threaded upper portion 11 of closure 1.

Figure 8:
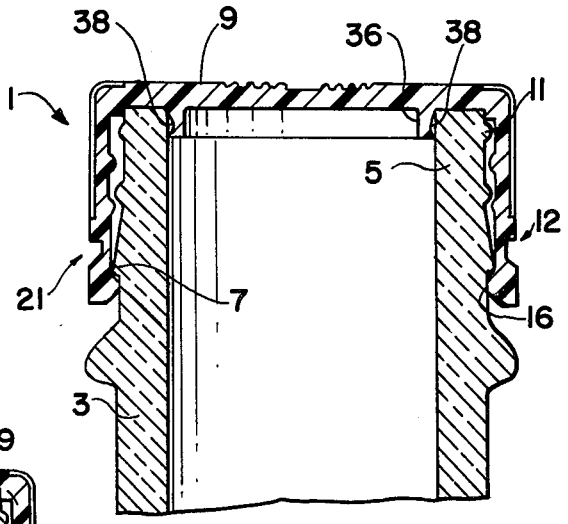
FIG. 8 is a side, elevational, cross-sectional view of another tamper-evident closure of the present invention completely threaded onto a container.
Figure 9:
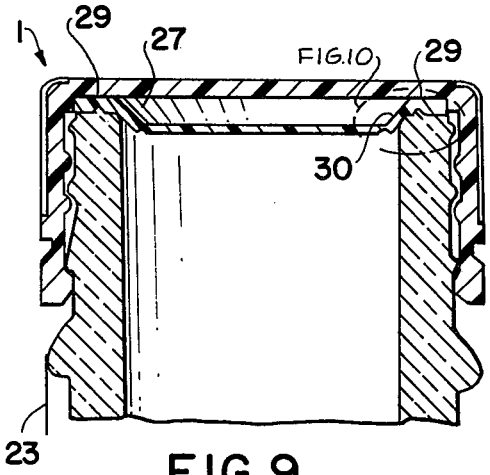
FIG. 9 is a side, elevational, cross-sectional view of another tamper-evident closure of the present invention completely threaded onto a container.

In FIG. 8, yet another type of seal is shown. In this case, a seal such as that which is shown in U.S. Pat. No. 4,033,472 to Obrist is utilized. This seal includes an inner annular sealing rail 36, which again projects from the inner face of end wall 9. In this case, however, the seal is intended to be located within the upper end of the neck portion of the container when the closure is completely threaded onto the container. Projecting outwardly from annular sealing rail 36 is an annular bead portion 38, so as to ensure firm contact between the bead 38 and the inner wall of the container 3.

Figure 11:
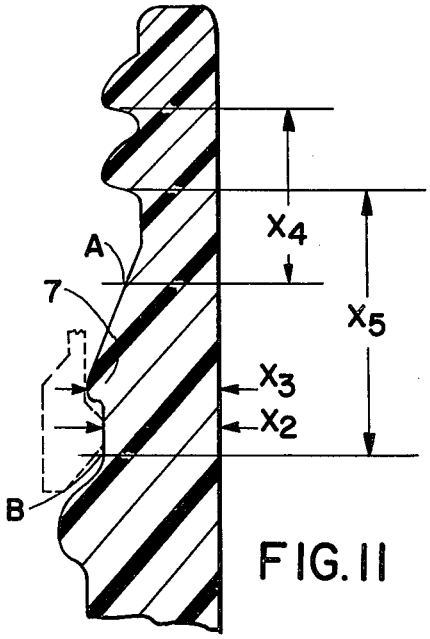
FIG. 11 is a partial, side, cross-sectional, elevational view of a portion of a container preferred for use in connection with the tamper-evident closures of the present invention.

In addition to all of the above, however, a particularly preferred container for use in connection with the closure of the present invention is shown in the embodiment of FIG. 11 hereof. This container again includes annular collar 7 below the threaded portion 5 thereof. Furthermore, below annular collar 7 is located transfer bead 35 as discussed above. The most significant dimension in this case is the height of the annular collar 7 above the wall of the bottle immediately therebelow. That is, dimension $x_3$ shown in FIG. 11 represents the thickness of the container at the thickest point on annular collar 7. On the other hand, dimension $x_2$ represents the thickness of the container immediately below annular collar 7. The distance $x_3-x_2$ is particularly important in connection with application of the closure of this invention. That distance $(X_3-X_2)$ should be between about 0.015 and 0.025 inches, and preferably about 0.018 inches. As can be seen, this distance corresponds to the preferred height of the inwardly projecting bead 16 on the closure hereof. In this most preferred embodiment, when the closure is fully screwed onto the bottle or other container in the manner shown in FIG. 6, there will be a firm engagement between the inner surface of the inwardly projecting bead 16 and the surface of the container represented by dimension $x_2$, i.e., immediately below annular collar 7. Because of this engagement, when the closure is unscrewed from the container the depending lower skirt portion 12 will not shift significantly to one side or the other, i.e., circumferentially all around the closure at that point the closure surface will be in substantial contact with the container to a substantially equal extent, thus preventing such shifting. In this manner, the inwardly projecting bead 16 cannot pass over the annular collar 7 of the container at any point around its circumference before bridges 14 are broken substantially simultaneously entirely around that circumference.

Finally, there is yet another relationship which can be of significance in connection with the closures of this invention. Referring again to FIG. 11, a dimension $x_4$, representing the distance between the bottom of the initial thread on the bottle to a point (A) substantially midway between the bottom of the threads and the annular collar 7, must be greater than the distance $x_5$, representing the distance between the bottom of the threaded portion of the container and a point below the annular collar 7 of the container which is intended to correspond (i.e.—when the closure has been applied) to a point (B) substantially midway along lower surface 19 of the inwardly projecting bead 16 of the closure (as is seen in phantom view in FIG. 11). The reason for this is that points A and B (or the point on the closure corresponding to point B) represent the initial points of contact between the closure and the container as the closure is being applied. The effect of these dimensional relationships (i.e.—that $x_4$ must be greater than $x_5$) is thus to insure that the closure threads and the bottle are in engagement before these locations come into contact with each other. This, in turn, permits application of the closure in the manner discussed above.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What is claimed is:

1. A tamper-evident closure for use in connection with a container including a threaded neck portion and an annular collar portion below said threaded neck portion, said closure comprising a one-piece plastic closure body including a horizontal end wall and a cylindrical side wall, said cylindrical side wall including an internally threaded upper portion, a depending lower skirt portion, and an intermediate side wall portion therebetween. said depending lower skirt portion including an inwardly projecting bead adapted to engage said container when said closure is completely threaded onto said container, said intermediate side wall portion of said closure including a frangible portion comprising an area of weakness designed to fracture when said closure is unthreaded from said container after said internally threaded upper portion has been removed from said container, said frangible portion thereby dividing said intermediate side wall portion into an upper intermediate side wall portion and a lower intermediate side wall portion above and below said frangible portion, respectively, said upper and lower intermediate side wall portions having substantially identical crossectional thicknesses, and said frangible portion comprising bridge means located circumferentially around said closure, said bridge means being sufficiently thin and flexible and having a sufficient length so as to be capable of collapsing when said inwardly projecting bead passes over said annular collar portion of said container as said closure is being threaded onto said container to thereby permit said upper and lower intermediate side wall portions to abut against each other and thereby permit said closure to be applied to said container without fracturing said bridge means, at least a portion of said upper and lower intermediate side wall portions including juxtaposed parallel surfaces to maintain said upper and lower intermediate side wall portions in alignment with each other upon said collapse of said bridge means.

2. The tamper-evident closure of claim 1, including stabilizer means independent of said bridge means for preventing said upper and lower intermediate side wall portions from rotating relative to each other upon said collapse of said bridge means.

3. The tamper-evident closure of claim 1 or 2, wherein said bridge means comprises a plurality of bridge members located circumferentially around said closure.

4. The tamper-evident closure of claim 3, including four of said bridge members located equidistantly about said closure.

5. The tamper-evident closure of claim 2, wherein said stabilizer means comprises interlocking male and female stabilizer means, said male stabilizer means being located on one of said upper and lower intermediate side wall portions and said female stabilizer means being located on the other of said one of said upper and lower intermediate side wall portions.

6. The tamper-evident closure of claim 5, wherein said frangible portion comprises a circumferential groove formed on the outer surface of said closure whereby said groove is bounded by said upper and lower intermediate side wall portions, and wherein said male stabilizer means comprises tab means projecting into said groove and said female stabilizer means comprises slot means corresponding to said tab means whereby said tab means enters said slot means upon said collapse of said bridge means.

7. The tamper-evident closure of claim 5, wherein said male and female stabilizer means each comprises a plurality of pairs of male and female stabilizer members.

8. The tamper-evident closure of claim 7, whereiin said bridge means comprises a plurality of bridge members located circumferentially around said closure.

9. The tamper-evident closure of claim 1 or 5, wherein said upper intermediate side wall portion comprises a substantially horizontal surface and said lower intermediate side wall portion comprises an inclined surface with respect to the horizontal.

10. The tamper-evident closure of claim 9, wherein said tab means is located on said lower intermediate side wall portion and said slot means is located on said upper intermediate side wall portion.

11. The tamper-evident closure of claim 1 or 2, wherein said inwardly projecting bead includes an inclined lower surface defining a plane disposed at a first angle with respect to the horizontal, for assisting in the gradual outward bending of said depending lower skirt portion as it passes over said annular collar portion of said container upon said threading of said closure onto said container without fracturing said frangible portion, and an inclined upper portion defining a plane disposed at a second angle with respect to the horizontal for engagement with said annular collar portion of said container when said closure is competely threaded onto said container, said second angle being greater than said first angle, whereby said depending lower skirt portion cannot gradually bend outward when said closure is unthreaded from said container without causing said fracture to occur.

12. The tamper-evident closure of claim 1 or 2, wherein said inwardly projecting bead extends inwardly from said cylindrical side wall a distance of between about 0.015 and 0.030 inches.

13. The tamper-evident closure of claim 12, wherein said inwardly projecting bead extends inwardly from said cylindrical side wall a distance of about 0.02 inches.

14. The tamper-evident closure of claim 1 or 2, wherein said container has a predetermined diameter at a location immediately below said annular collar portion, and wherein said inwardly projecting bead extends inwardly a predetermined distance from said cylindrical side wall so as to create a minimum internal bead diameter, said minimum internal bead diameter substantially corresponding to said predetermined diameter.

15. The tamper-evident closure of claim 14, wherein said inwardly projecting bead extends inwardly from said cylindrical side wall a distance of between about 0.015 and 0.030 inches.

16. The tamper-evident closure of claim 15, wherein said annular collar portion of said container extends outwardly from said location on said container having said predetermined diameter a distance of between about 0.015 and 0.25 inches.

17. The tamper-evident closure of claim 16, wherein said annular collar portion of said container extends outwardly from said location on said container having said predetermined diameter a distance of about 0.018 inches.

18. The tamper-evident closure of claim 3, wherein said bridge members have a thickness of between about 0.003 and 0.015 inches.

19. A tamper-evident closure for use in connection with a container including a neck portion and an annular collar portion below said neck portion, said closure comprising a one-piece plastic closure body including a horizontal end wall and a cylindrical side wall, said cylindrical side wall including an upper portion, a depending lower skirt portion, and an intermediate side wall portion therebetween, said depending lower skirt portion including an inwardly projecting bead adapted to engage said container when said closure is applied to said container, said cylindrical side wall including a circumferential groove formed on the outer surface of said closure to thereby provide a frangible portion having a substantially uniform wall thickness at a predetermined location on said intermediate side wall, said predetermined location being located above said inwardly projecting bead so as to divide said intermediate side wall portion into an upper intermediate side wall portion and a lower intermediate side wall portion above and below said predetermined location, respectively, said upper and lower intermediate side wall portions being in substantial alignment with each other in the plane of said cylindrical side wall and having substantially identical crosssectional thicknesses, said frangible portion being sufficiently thin and flexible and having a sufficient length so as to be capable of collapsing when said inwardly projecting bead passes over said annular collar portion of said container as said closure is being applied to said container, to thereby permit said upper and lower intermediate side wall portions to abut against each other and thereby permit said closure to be applied to said container without fracturing, said frangible portion further being designed to fracture in a substantially horizontal plane across said closure when said closure is removed from said container

20. The tamper-evident closure of claim 19 wherein said frangible portion comprises a plurality of bridge means separated by slots therebetween, whereby each of said bridge means has said substantially uniform wall thickness.

21. A tamper-evident closure for use in connection with a container including a neck portion and an annular collar portion below said neck portion, said closure comprising a one-piece plastic closure body including a horizontal end wall and a cylindrical side wall, said cylindrical side wall including an upper portion, a depending lower skirt portion, and an intermediate side wall portion therebetween, said depending lower skirt portion including an inwardly projecting bead adapted to engage said container when said closure is applied to said container, said intermediate side wall portion of said closure including a frangible portion comprising an area of weakness designed to fracture when said closure is removed from said container after said upper portion has been removed from said container, said frangible portion thereby dividing said intermediate side wall portion into an upper intermediate side wall portion and a lower intermediate side wall portion above and below said frangible portion, respectively, said upper and lower intermediate side wall portions having substantially identical cross-sectional thicknesses, and said frangible portion comprising bridge means located circumferentially around said closure, said bridge means being substantially vertically disposed along the inner surface of said cylindrical side wall, and being sufficiently thin and flexible and having a sufficient length so as to be capable of collapsing when said inwardly projecting bead passes over said annular collar portion of said container as said closure is being applied to said container to thereby permit said upper and lower intermediate side wall portions to abut against each other and thereby permit said closure to be applied to said container without fracturing said bridge means.

22. A tamper-evident closure for use in connection with a container including a neck portion and an annular collar portion below said neck portion, said closure comprising a one-piece plastic closure body including a horizontal end wall and a cylindrical side wall, said cylindrical side wall including an upper portion, a depending lower skirt portion, and an intermediate side wall portion therebetween, said depending lower skirt portion including an inwardly projecting bead adapted to engage said container when said closure is completely applied to said container, said intermediate side wall portion of said closure including a frangible portion comprising an area of weakness designed to fracture when said closure is removed from said container after said upper portion has been removed from said container, said frangible portion thereby dividing said intermediate side wall portion into an upper intermediate side wall portion and a lower intermediate side wall portion above and below said frangible portion, respectively, said upper and lower intermediate side wall portions being in substantial alignment with each other in the plane of said cylindrical side wall, and having substantially identical cross-sectional thicknesses, said frangible portion comprising bridge means displaced inwardly with respect to the outer surface of said cylindrical side wall, extending substantially vertically between said upper and lower intermediate side wall portions, and being sufficiently thin and flexible so as to be capable of collapsing when said inwardly projecting bead passes over said annular collar portion of said container as said closure is being applied to said container to thereby permit said upper and lower intermediate side wall portions to abut against each other and thereby permit said closure to be applied to said container without fracturing said bridge means.

23. The tamper-evident closure of claim 19, 21 or 22 wherein at least a portion of said upper and lower intermediate side wall portions include juxtaposed parallel surfaces to maintain said upper and lower intermediate side wall portions in alignment with each other upon said collapse of said frangible portion.

24. The tamper-evident closure of claim 23, including stabilizer means independent of said frangible portion for preventing said upper and lower intermediate side wall portions from rotating relative to each other upon said collapse of said bridge means.

25. The tamper-evident closure of claim 21 or 22, wherein said bridge means comprises a plurality of bridge members located circumferentially around said closure.

26. The tamper-evident closure of claim 25, including four of said bridge members located equidistantly about said closure.

27. The tamper-evident closure of claim 24, wherein said stabilizer means comprises interlocking male and female stabilizer means, said male stabilizer means being located on one of said upper and lower intermediate side wall portions and said female stabilizer means being located on the other of said one of said upper and lower intermediate side wall portions.

28. The tamper-evident closure of claim 21 or 22, wherein said inwardly projecting bead includes an inclined lower surface defining a plane disposed at a first angle with respect to the horizontal, for assisting in the gradual outward bending of said depending lower skirt portion as it passes over said annular collar portion of said container as said closure is applied to said container without fracturing said frangible portion, and an inclined upper portion defining a plane disposed at a second angle with respect to the horizontal for engagement with said annular collar portion of said container when said closure has been applied to said container, said second angle being greater than said first angle, whereby said depending lower skirt portion cannot gradually bend outward when said closure is removed from said container without causing said fracture to occur.

29. The tamper-evident closure of claim 19, 21 or 22, wherein said inwardly projecting bead extends inwardly from said cylindrical side wall a distance of between about 0.015 and 0.030 inches.

30. The tamper-evident closure of claim 29, wherein said inwardly projecting bead extends inwardly from said cylindrical side wall a distance of about 0.02 inches.

31. The tamper-evident closure of claim 19, 21 or 22, wherein said container has a predetermined diameter at a location immediately below said annular collar portion, and wherein said inwardly projecting bead extends inwardly a predetermined distance from said cylindrical side wall so as to create a minimum internal bead diameter, said minimum internal bead diameter substantially corresponding to said predetermined diameter.

32. The tamper-evident closure of claim 31, wherein said inwardly projecting bead extends inwardly from said cylindrical side wall a distance of between about 0.015 and 0.030 inches.

33. The tamper-evident closure of claim 25, wherein said bridge members have a thickness of between about 0.003 and 0.015 inches.

34. The tamper-evident closure of claims 1, 19, 21 or 22 wherein said inwardly projecting bead has an internal diameter adapted to firmly engage said container below said annular collar portion of said container, so as to leave said depending lower skirt portion on said container after said internally threaded upper portion has been removed from said container.

* * * * *